US005547111A

United States Patent [19]

Geiger et al.

[11] Patent Number: 5,547,111

[45] Date of Patent: Aug. 20, 1996

[54] DEVICE TO CLOSE A SIDE DISPENSING ORIFICE BY AXIAL SLIDING WITH PUSH BUTTON ELEMENT

[76] Inventors: Reinold Geiger, 3 rue Salomon Reinach, 78100 Saint Germain en Laye; André Tartaglione, 20 rue Ampére, 01112 Oyonnax, both of France

[21] Appl. No.: 263,836

[22] Filed: Jun. 22, 1994

[30] Foreign Application Priority Data

Jun. 22, 1993 [FR] France ..... 93 07561

[51] Int. Cl.[6] ..... B67D 3/00

[52] U.S. Cl. ..... 222/505; 222/522

[58] Field of Search ..... 222/505, 509, 222/531–537, 556, 559, 522

[56] References Cited

U.S. PATENT DOCUMENTS

| | | | |
|---|---|---|---|
| 3,516,581 | 6/1970 | Micallef | 222/534 X |
| 4,487,342 | 12/1984 | Shy | 222/534 X |
| 4,776,501 | 10/1988 | Ostrowsky | 222/534 X |
| 4,779,774 | 10/1988 | Morel . | |
| 4,982,882 | 1/1991 | Gueret | 222/531 |
| 5,065,912 | 11/1991 | Rosenthal | 222/534 X |
| 5,236,107 | 8/1993 | Spaanstra, Sr. | 222/534 |
| 5,284,264 | 2/1994 | Gross | 222/534 X |
| 5,314,093 | 5/1994 | Gross et al. | 222/534 X |
| 5,341,960 | 8/1994 | Lay | 222/536 X |
| 5,370,284 | 12/1994 | Dirksing | 222/534 |
| 5,377,870 | 1/1995 | Morel | 222/532 X |

FOREIGN PATENT DOCUMENTS

| | | |
|---|---|---|
| 0111813 | 6/1984 | European Pat. Off. . |
| 1171092 | 1/1959 | France . |

*Primary Examiner*—Kevin P. Shaver
*Attorney, Agent, or Firm*—Young & Thompson

[57] ABSTRACT

The invention relates to a device to open and close a side dispensing orifice (1) by sliding comprising a lateral skirt (8) and a transversal wall (9) having an evacuation passage (10) of the content, a dispensing element (4) comprising a lateral wall (11) coming in contact against the lateral skirt (8) of the cap (3), a top face (12), and an elbowed passage (13) for the content, in connection with the extremity in the axial direction with the evacuation passage (10) and emerging at a radial extremity on the lateral wall (11) by a lateral dispensing orifice (1). The dispensing element (4) is slidingly mounted in an axial direction (D) on the cap (3) between two extreme positions, of closing and of opening, respectively. According to the invention, the dispensing element (4) divides the cavity defined by the lateral skirt (8) and the transversal wall (9) of the cap (3) with a push button element (4) slidingly mounted on the cap (3) in the axial direction between a rest position and an active position, and comprising a lateral wall (14) coming partly in contact against the lateral skirt (8) of the cap (3), a top face (15). The device comprises a transmission element (6) transmitting the movement of the push button element (5) from the rest position to the active position into movement of the dispensing element (4) from the closed position to the open position.

12 Claims, 3 Drawing Sheets

DEVICE TO CLOSE A SIDE DISPENSING ORIFICE BY AXIAL SLIDING WITH PUSH BUTTON ELEMENT

The invention relates to an apparatus to close a side dispensing orifice of a container such as a squeezable tube enclosing a liquid or paste content; a tube comprising such a device and a procedure to fill it up.

A device of this type is known in which the orifice is located either on a fixed part (see FR-A-968 331); or in a mobile part (see DE-A-2 211 277, U.S. Pat. No. 4,295,584, FR-A-1 190 757, FR-A-1 145 077, U.S. Pat. No. 4,779,774, EP-A-111 813).

These known devices have many problems. Problems of hygiene: waterproofness, cleanliness around the orifice, preservation of the contents from the ambient atmosphere. Problems of cost, of fabrication, of assembly, of reliability, and aesthetics. Ergonomic problems to facilitate handling. Thus, the device according to EP-A-0 111 81 3 does not seem very practical.

The goal of this invention is to definitively solve these problems.

To carry this out, the invention proposes a device to close a side dispensing orifice by sliding for a container such as a squeezable tube comprising a cap having a lateral skirt and a transversal wall provided with a content evacuation passage, a dispensing element having a lateral wall coming against the lateral skirt, a top face, and having an elbowed passage for the content extending partially in the direction of sliding and partially radially, connecting with the passage and emerging on the wall from the orifice, said element being mounted by axial sliding on the cap between two positions, of closing where the skirt masks the orifice and of opening where the orifice is uncovered, respectively; guiding means, sliding means and blocking means at end of travel of the element with respect to the cap; and means to control the sliding of the element; characterized in that the controlling means comprise a push button element lodged with the dispensing element in the cavity defined by the skirt and the wall; mounted by axial sliding on the cap between a rest position and an active position respectively; comprising a lateral wall extending in part against the skirt of the cap, a top face; and in that it comprises guiding means, sliding means, and blocking means between these two positions and a transmission element of the movement of the push button of the dispensing element and inversely, in the opposite direction, in the form of a pivoting element associated with the cap, in rotation about an axis orthogonal to the axial direction, comprising two parts disposed on each side of the axis each respectively in contact with the dispensing element or the push button element.

The invention will be better understood thanks to the description referring to the drawings.

Figure 1:
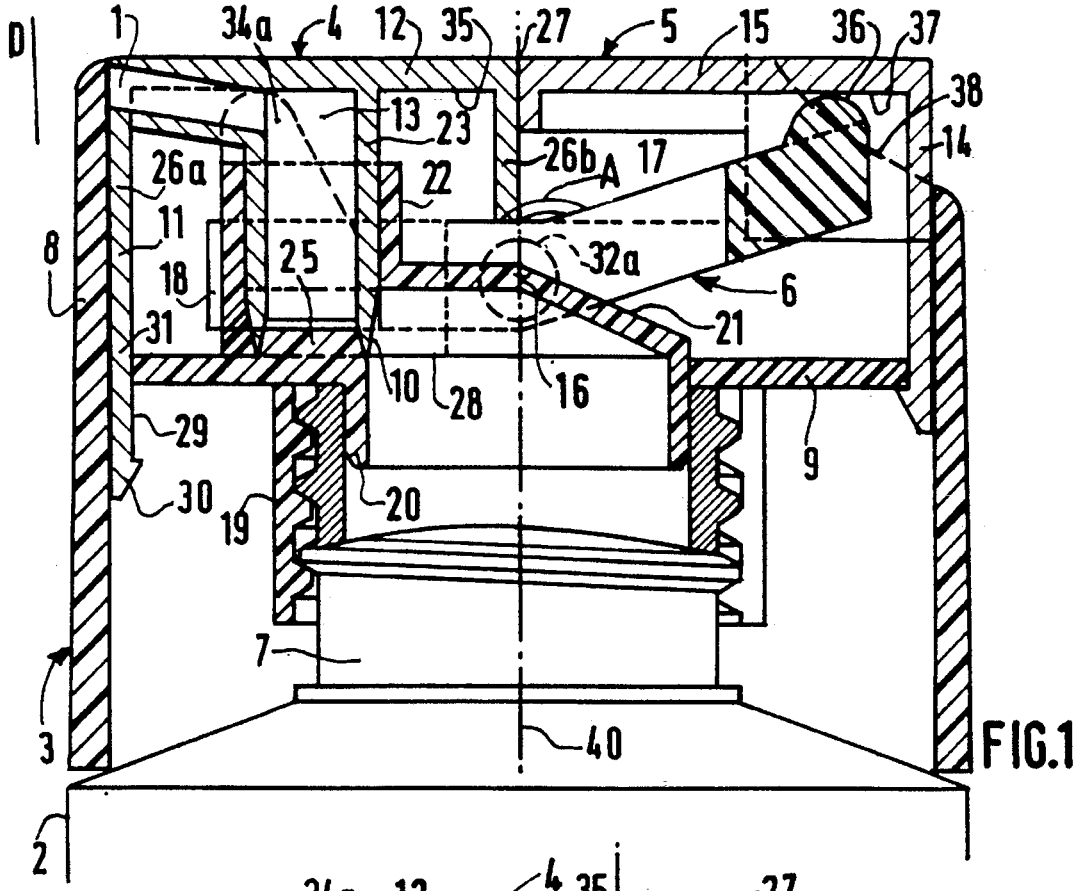
FIGS. 1 and 2 are two cross-sectional views of a first embodiment in the closed and open positions, respectively.

A device to close a side dispensing orifice 1 is intended for a container 2 such as a squeezable tube for a liquid or paste content.

The assembly device/container 2 has a main axis 40 or axial direction D.

The container 2 comprises a content dispensing opening, having an axis 40. That is to say (FIG. 1), the container 2 is distinct from the device and brought against it. The container 2 comprises then a collar 7 of axis 40 onto which the device is mounted. That is to say (FIG. 4), the device is an integral part of the container 2.

The device comprises distinct parts, a cap 3, a dispensing element 4, a push button element 5 and a swinging element 6.

The cap 3 is secured to the container 2 around its collar 7. Either it is brought against the container 2 (first embodiment), or it comes with it upon manufacture (second embodiment.

The cap 3 comprises a lateral skirt 8 and a transversal wall 9 equipped with an evacuation passage 10 of the content.

In the first embodiment, the skirt 8 extends the lateral wall of the container 2. In the second embodiment, the skirt 8 also constitutes this lateral wall. In this case, the cap 3 is not distinct from the container 2 but constitutes one of its extremities.

The element 4 comprises a lateral wall 11 coming partially against the skirt 8 and a top face 12. There is an elbowed passage 13 for the content, which extends partially in the direction of axial sliding and partially radially. The passage 13 is connected at its extremity of axial direction with the passage 10 and emerges at its radial direction extremity against the wall 11 by the orifice 1.

The element 4 is mounted by axial sliding on the cap 3 thanks to complementary guiding and sliding means between two extreme positions, a closed position (FIG. 1) where the skirt 8 masks the orifice 1, and an open position (FIGS. 2 and 4) where the orifice 1 is uncovered, respectively, thanks to complementary blocking means limiting the sliding curve.

The cavity defined by the skirt 8 and the wall 9 comprises as well the push button element 5 having a lateral wall 14 coming in part against the skirt 8 and the top face 15. The element 5 is mounted by sliding on the cap 3 in the direction D between two extreme positions, a position of rest (FIG. 1) and an active position (FIGS. 2 and 4), respectively. There is provided on the cap 3 and the element 5 complementary guiding and sliding means, and blocking means between the two extreme positions.

The element 6 transmits the movement of the element 5 from the rest position to the active position into a movement of the element 4 from the closed position to the opened position. The element 6 also transmits the movement of the element 4 from the opened position to the closed position into a movement of the element 5 from its active position to its rest position.

The element 6 engages the dispensing element 4 and the push button element 5 in opposite directions.

The element 6 is pivoting and is associated with the cap 3 in rotation about an axis 16 orthogonal to the direction D, comprising two parts 17, 18 provided on each side of the axis 16, each in contact with the element 4 or the element 5, respectively.

An axial depressing force applied on the push button element 5 in its rest position provokes a movement of elevation on the dispensing element 4 from its closed position. Inversely, an axial depressing force on the element 4 in its opened position has the consequence of generating a rising movement of the push button element 5 from its active position.

According to FIG. 1, the wall 9 comprises, on the container 2 side, a threaded main annular axial extension 19 which cooperates with the complementary threaded collar 7 of the container 2. The wall 9 comprises as well, on the container 2 side, a secondary annular axial extension 20 which guarantees the waterproofness between the container 2 and the passage 10. On the element 4 side, the wall 9 comprises a dome element 21 covering the opening of the container 2 and presenting peripherally and laterally the passage 10.

The passage 10 is peripherally and laterally connected with an eccentric shaft 22 of direction D adjoining and tied to the wall 9. The purpose of the shaft 22 is to cooperate in a watertight fashion with the part of the passage 13 which is in the axial direction whatever the position of the element 4.

Figure 4:
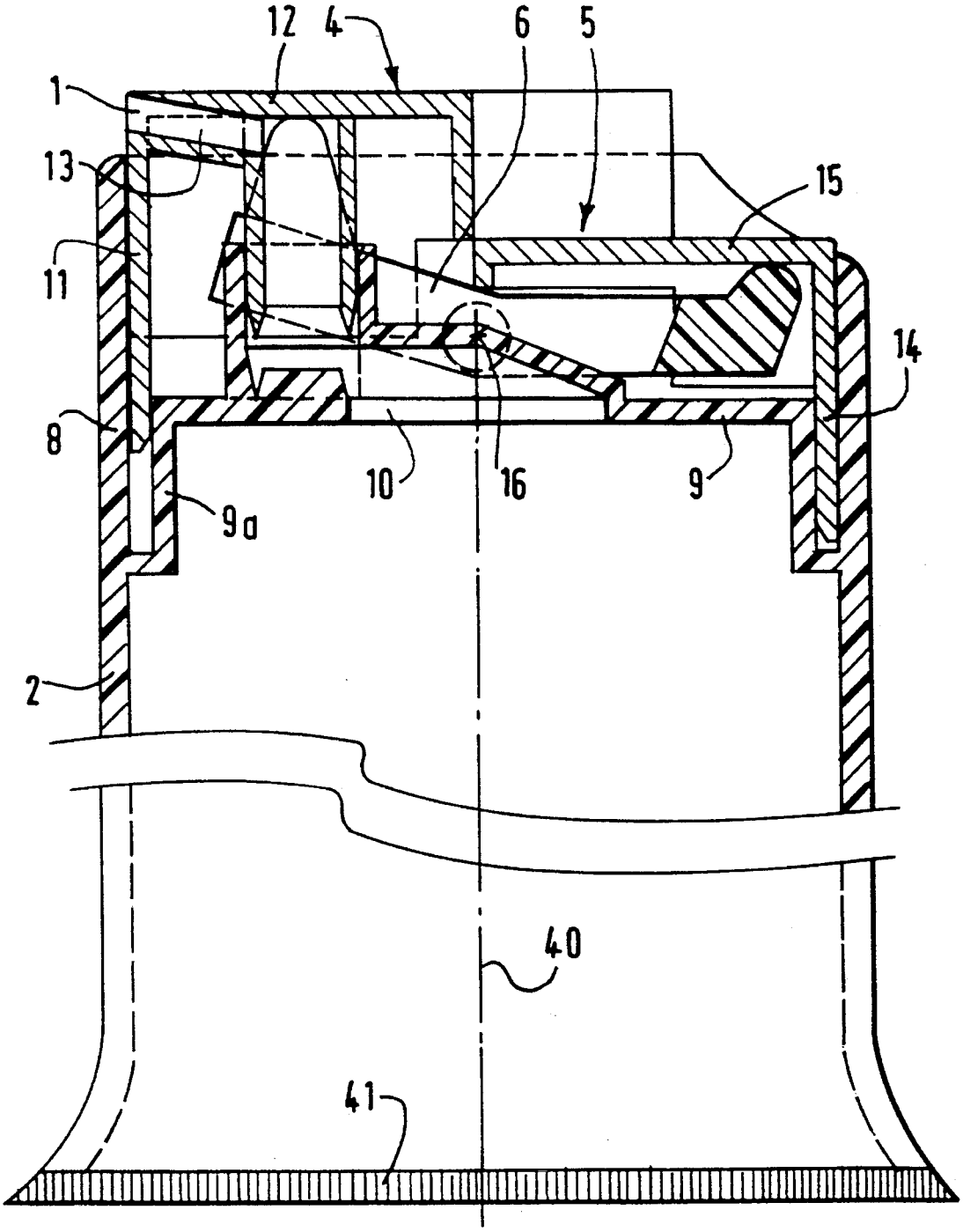
FIG. 4 is a cross-sectional view of a second embodiment.

According to FIG. 4, the wall 9 is only pierced by the passage 10 and at its periphery, two elbowed lateral uncouplings 9*a* are adjoining, diametrally opposed, which, with the skirt 8, form two reserves for the housing of walls 11 and 14 of the element 4 and of the element 5 respectively. These uncouplings 9*a* connect the wall 9 to the skirt 8 and guarantee the waterproofness between the container 2 and the elements 4 and 5. Besides these uncouplings 9*a*, the skirt 8 and the wall 9 are directly connected.

The part of the passage 13 in the direction D is a shaft 23 whose exterior wall cooperates in a coaxial and waterproof manner with the interior wall of the shaft 22.

The passage 10, the shafts 22, 23 and the radial part of the passage 13 define together an evacuation canal 24 which is waterproof between the interior of the container 2 and the exterior when the dispensing element 4 is in the open position.

In the closed position of the element 4, the shaft 23 seals the passage 10. A waterproof pin 25 provided at the bottom of the shaft 22, adjoining the transversal wall 9 closes in a waterproof fashion the shaft 23 in the closed position of the element 4.

The guiding and sliding means in axial direction D of the element 4 comprise a part 26*a* of the lateral wall 11 in sliding contact with the skirt 8 and a part 26*b* in sliding contact with a part of the wall 14 along a dividing line 27 of the cavity.

The guiding and sliding means of the element 5 comprise a part of the wall 14 in sliding contact with the skirt 8 and on the other side in sliding contact with the part 26*b* of the lateral wall of the element 4.

The means for blocking the travel of the element 4 comprise the free edge 28 of the wall 11 limiting the travel of closing by coming in abutment against the wall 9, and at least a lip 29 coming in extension of the wall 11, provided at its free extremity with a transversal abutment 30. This lip 29 slides in a slit 31 of the wall 9. The abutment 30 limits the opening travel from the abutment against the periphery of the slit 31 on the collar 7 side of the wall 9. In the second embodiment, the lip slides in the reserve located in the uncoupling 9*a*.

The blocking means of the travel of the push button element 5 are of the same type as those of the element 4, the free edge of the wall 14 limiting the travel to pass from the rest position to the active position and the lip-abutment-slit assembly acting to limit the travel to pass from the active position to the rest position.

The element 6 has a general stirrup shape and is associated with the cap 3 by two diametrally opposed radial pins 32*a*, 32*b* cooperating according to the axis 16 with the skirt 8. The element 6, in stirrup shape, has an open angle A between the free parts 18*a*, 18*b* of the stirrup provided on one side of the pins 32*a*, 32*b* and the linking part 17 of the stirrup provided on each side of the pins 32*a*, 32*b*.

The free parts 18*a*, 18*b* each comprise a contact pin 34*a*, 34*b* of direction D in contact with the interior face 35 of the wall 12, on each side of the passage 13. The linking part 17 has a pin 36 in direction D coming in contact with the interior face 36 of the top face 16.

The skirt 8 has an ergonomic notch 38 in sight of the element 5 which facilitates the application of the necessary force to make the element 5 go from the rest position to the active position and thus to make the element 4 pass from the closed position to the opened position.

The walls 12 and 15 of the elements 4 and 5 are flush with the border of the skirt 8. To go from the open position to the closed position of the device, the user may turn over the container and its closure device in order to put it down on the protruding wall outside of the skirt 8. The dispensing element being submitted to the weight of the container 2 and to its content will return automatically to the closed position by making the element 5 go from the active position to the rest position.

Figure 2:
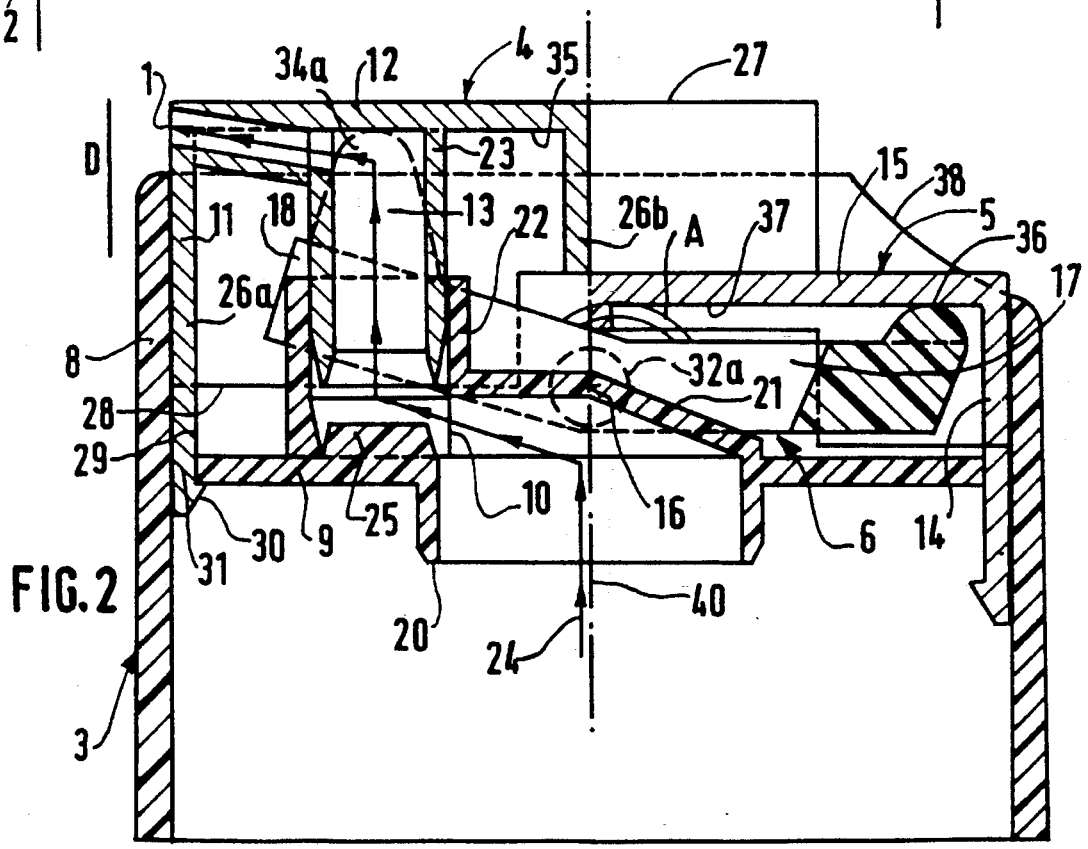
Figure 3:
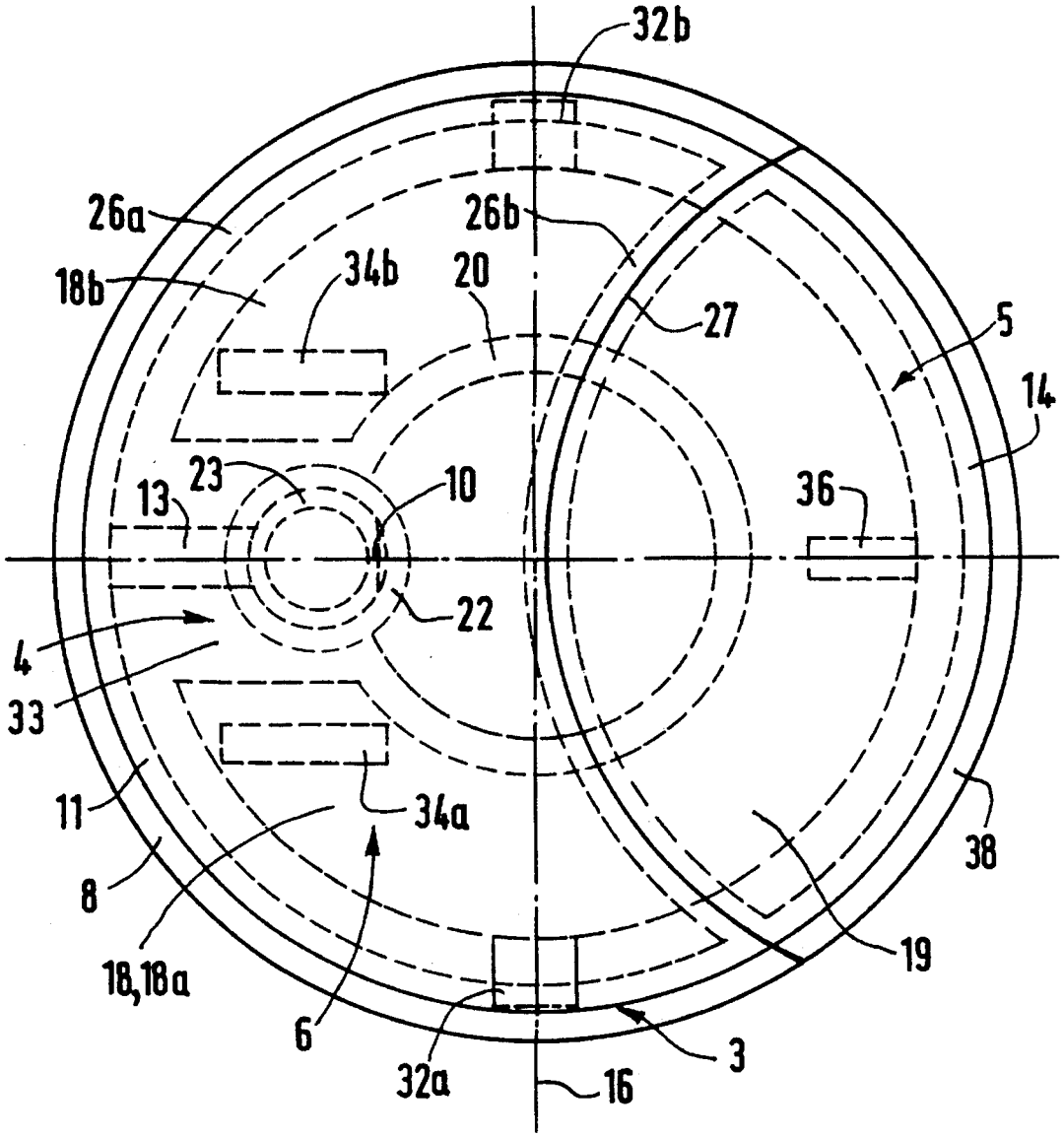
FIG. 3 is a top view of the first embodiment.

Below, the top is considered to be the top face side end and the bottom is considered to be the container side end, as it is represented in FIGS. 1, 2 and 4.

A user exerts an axial force directed from the top towards the bottom on the wall 15, which generates the axial sliding of the element 5 from the top towards the bottom, which generates in turn a rotation from the top towards the bottom of the part 17 of the element 6 about the axis 16, a rotation from the bottom towards the top of the part 18. It follows, by the agency of the two pins 34*a* and 34*b*, a force from the bottom towards the top applied on the interior face of the top face 12. This generates a sliding of axial direction of the element 4 which frees the orifice 1 and opens the passage 10, creating in this manner the evacuation passage 24 of the content of the container 2.

The skirt 8 is annular and circular. The element 4 has the general shape of a half-moon, and element 5 has a complementary shape in such a manner that the two elements 4 and 5 each fit within the circle defined by the skirt 8. The axis 16 is diametric, and the dividing line 27 is tangent to the axis 16.

The materials utilized for the realization of the various elements of the device are rigid plastic materials.

The device may be mounted on the container 2 which, at its opposed extremity 41 may then be opened. In this configuration, the device being closed, the container 2 may be filled with its content. Then, closed by pinching and securing on itself at the extremity 41. This procedure facilitates the filling up procedure and assembly of the container 2-device assembly.

According to an embodiment, not illustrated, of the first embodiment, the container 2 comprises a removable safety seal in the opening of the collar.

According to another embodiment, not illustrated, there is a tearable safety lip on the wall 14, between the skirt 8 and the wall 15. This lip, as long as it has not been ripped, keeps element 5 from being pushed down and thus the opening of the orifice 1.

What is claimed is:

1. Device to close by axial sliding a side dispensing orifice (1) for a container (2), the device comprising a cap (3) having a lateral skirt (8) and a transverse wall (9) provided with an evacuation passage (10); a dispensing element (4) having a lateral wall (11) in sliding contact with said lateral skirt (8), a top face (12), and an elbowed passage (13) extending partially in the direction of sliding and partially radially, communicating with said evacuation passage (10) and opening on said lateral wall (11) as said side dispensing orifice (1); said dispensing element (4) being slidably mounted partly into a cavity defined by said lateral skirt (8) and said transverse wall (9) of said cap (3) between a closed position wherein said lateral skirt (8) masks said side dispensing orifice (1) and an open position wherein said side dispensing orifice (1) is uncovered; first means for slidably guiding and blocking the sliding movement of the element (4) with respect to the cap (3); and means to control the sliding movement of said dispensing element (4); wherein said control means comprise a push button element (5)

mounted in sliding contact with said dispensing element (4) and said skirt (8) in order to slide axially in the cavity of the cap (3), between a rest position and an active position; the push button element (5) having a lateral wall (14) in sliding contact with said lateral skirt (8), and a top face (15); and wherein said device further comprises second means for slidably guiding and blocking said push button element (5) between said active and rest positions, and said control means further comprising a transmission element (6) for transmitting axially sliding movements of said push button element (5) to said dispensing element (4) and vice-versa, in an opposite direction, said transmission element (6) comprising a pivoting element mounted in the cavity of the cap (3), and rotatable about an axis (16) orthogonal to an axial direction (D), said transmission element (6) comprising two connected parts (17, 18) disposed on either side of said orthogonal axis (16) each said part (17, 18) being in contact with a respective one of said dispensing and push button elements (4, 5).

2. Device according to claim 1 wherein said transverse wall (9) comprises, toward the container (2) a main threaded axial annular extension (19) which cooperates with a complementary threaded collar (7) of the container (2); a secondary annular axial extension (20) which seals between the container (2) and the passage (10); and a dome element (21) covering an opening of the container (2), and defining peripherally and laterally said evacuation passage (10) in lateral and peripheral connection with a first eccentric shaft (22) extending in said axial direction (D) adjoining and connected to said transverse wall (9), cooperating in a sealing fashion with a part of said elbowed passage (13) in said direction (D) whatever the position of said dispensing element (4).

3. Device according to claim 2, wherein said part of said elbowed passage (13) is a second eccentric shaft (23) whose exterior wall cooperates coaxially and in sealed fashion with an interior wall of said first eccentric shaft (22), defining, in an open position of the dispensing element (4) and in association with said evacuation passage (10) and a radial part of said elbowed passage (13), a sealed evacuation canal (24) between the interior of the container (2) and an exterior of the device.

4. Device according to claim 3, wherein, in the closed position of said dispensing element (4), said second eccentric shaft (23) seals said evacuating passage (10), a sealing lug (25) being disposed at a bottom of said first eccentric shaft (22) closing said eccentric shaft (23).

5. Device according to claim 1, wherein said first means for slidably guiding and blocking comprise a first part (**26*a*) of said lateral wall (11) in contact with said lateral skirt (8) and a second part (26*b*) in contact with a part of said lateral wall (14) of said push button element (5) along a dividing line (27**) of the cavity.

6. Device according to claim 1, wherein said first means for slidably guiding and blocking comprise a free edge (28) of said lateral wall (11) limiting a closing travel by coming into abutment against said transverse wall (9), and at least a lip (29) extending from said lateral wall (11), provided at its free extremity with a transversal abutment (30), sliding in a slit (31) in said transverse wall (9), said abutment (30) limiting the opening travel of the dispensing element (4) by coming into abutment against the periphery of said slit (31).

7. Device according to claim 1, wherein the pivoting element (6) has a general shape of a stirrup and is connected to the cap (3) by two diametrically opposed radial pins (**32*a*, 32*b*) cooperating along the axis (16) with said lateral skirt (8), presenting an open angle (A) between free parts (18*a* and 18*b*) and a connecting part (17) provided on either side of the pins (32*a*, 32*b*) and wherein a part (33) disposed between the free parts (18*a*, 18*b*) allows passage of contents of the container (2**).

8. Device according to claim 7, wherein the free parts (**18*a*, 18*b*) of the pivoting element (6) each comprise a pin (34*a*, 34*b*) of axial direction in contact with an interior face (35) of a top face (12) of said dispensing element (4), on either side of said elbowed passage (13), and wherein the connecting part (17) has a pin (36) in axial direction in contact with an interior face (37) of a top face (15) of said push button element (5**).

9. Device according to claim 1, wherein said lateral skirt (8) has a notch (38) providing access to said push button element (5).

10. Device according to claim 1, wherein in the closed position, top faces (12, 15) of said dispensing and push button elements (4) and (5) are flush with a border of said lateral skirt (8).

11. Device according to claim 1, wherein said device is made of rigid plastic materials.

12. Device according to claim 1, wherein said device is manufactured with the container (2), the cap (3) being an integral part of the container (2) whose lateral skirt (8) contacts said lateral wall.

* * * * *